United States Patent [19]

Diel

[11] Patent Number: 4,736,672

[45] Date of Patent: Apr. 12, 1988

[54] METERED LOCKOUT VALVE

[75] Inventor: Robert M. Diel, Hutchinson, Kans.

[73] Assignee: Cessna Aircraft Company, Wichita, Kans.

[21] Appl. No.: 848,780

[22] Filed: Apr. 7, 1986

[51] Int. Cl.[4] ..... F01B 3/00

[52] U.S. Cl. ..... 91/445; 137/596.2

[58] Field of Search ..... 91/445, 420; 137/596.2

[56] References Cited

U.S. PATENT DOCUMENTS

| | | | |
|---|---|---|---|
| 3,596,566 | 8/1971 | Krehbiel | 91/477 X |
| 3,906,991 | 9/1975 | Haussler | 91/420 X |
| 4,545,287 | 10/1985 | Jackson | 91/420 |
| 4,624,445 | 11/1986 | Putnam | 91/420 X |

*Primary Examiner*—William E. Wayner

*Attorney, Agent, or Firm*—Edward L. Brown, Jr.

[57] ABSTRACT

A lockout valve in a hydraulic system which meters the flow thereacross in accordance with the actuation pressure applied. The lockout valve is positioned in a circuit between the motor supporting the load and the directional control valve blocking flow from the motor; the lockout includes a spring-biased poppet urged against a seat; the poppet is slidably positioned in a bore defining a servo chamber therebehind; spring means urging the poppet means closed against the seat, the poppet including a head portion with a face thereon which seals against the seat, the head portion having a larger diameter than the first bore whereby a closing area is provided on the poppet subject to load pressure urging the poppet closed; the poppet including a sensing passage connecting the face of the poppet with said first bore and a stem means on the poppet downstream of the face which provides a turning surface for the high speed jet of oil passing through the lockout and a servo plunger in the lockout downstream of the poppet sensing pressure and acting against the stem means and the flow of oil flowing past the poppet.

8 Claims, 1 Drawing Sheet

METERED LOCKOUT VALVE

BACKGROUND OF THE INVENTION

The invention relates to control valves for controlling the operation of fluid motors supporting gravity loads and more particularly to lockout check valves utilized in the motor ports of spool type directional control valves. Hydraulic systems which lift heavy loads by spool type directional control valves have utilized an additional valve in the circuit commonly known in the trade as a "lockout" valve which is positioned in the lines between the directional control valve and the working cylinder. The need for these additional lockout valves is caused by normal spool leakage in a directional control valve which if left in neutral would slowly allow the load to drop due to normal tolerance leakage across the spool lands of the control valve.

A lockout valve has essentially no leakage, and is a spring-closed check valve positioned in each motor port of the directional control valve which prevents any leakage from the cylinder to the valve until they are forced open by pressure from the pump source. The prior art lockout type control valves, such as shown in U.S. Pat. No. 3,596,566, depend on pressure fluid flowing from the pump source outward through one or the other motor ports of the valve to open both lockout check valves. In such a system when the piston rod of the controlled motor is subjected to a large external load, there is a great pressure variation in the fluid flow path in which each lockout check valve is interposed. As the piston rod is accelerated due to the external load, the cylinder begins to outrun the pump causing a drop in pressure in the pump supply path to one side of the cylinder. This lowers the pressure tending to hold the lockouts open and both lockouts momentarily spring-closed. Their closing causes an instant stoppage of the cylinder piston and a resultant shock to the entire system. When fluid from the pump source again builds up sufficient pressure, both lockouts are reopened and the cycle is repeated. This phenomenon is known in the valve art as "lockout chatter" and regardless of efforts, the valve operator is incapable of accurately positioning the cylinder rod and its attached load or of accurately controlling the rate of movement of the load. All of this is due to the above-described instability of the lockout checks under heavy load.

Past efforts to overcome the lockout chatter problem, such as severely restricting the maximum return flow from the motor, have created a large operating efficiency loss which drastically limits the speed of movement and reaction time of cylinder movement on the machine.

One method of solving this chatter problem is illustrated in the above-mentioned patent wherein the timing of the control valve is changed so that the lockouts are fully open before there is any flow to or from the motor with the utilization of a separate pressure cavity to hold the lockouts open. This system requires a very complex valve coring and spool design to provide for all of the additional passages and valving functions. While the system does decrease the possibilities of chatter, it does not prevent the motor from overrunning the pump and cavitating the system.

In typical lockout valve designs such as the above-mentioned patent, the valve is either fully closed or fully opened. When a lockout is closed, the pressure created by the load acts on the backside thereof until the pump pressure actuated plunger overcomes that force and pushes the lockout poppet open. Once the load pressure on the backside is broken as the valve opens, the lockout snaps to the full open position with no intermediate positions.

While typical lockout valves are only two-position, either closed or fully open, another solution to the same problem is taught in U.S. Pat. No. 4,545,287. In this lockout valve, the poppet meters the flow with an infinite number of positions, rather than just an open or closed position.

DESCRIPTION OF THE PRESENT INVENTION

The lockout valve of the present invention is also a metering type lockout as described in the last patent. The metering characteristics rather than the closed-fully open characteristics of other lockout valves are obtained by requiring a positive opening characteristic curve. As for example, at any given work port pressure, increasing flow rates through the lockout valve require increasing pressure on the plunger. This allows the lockout to provide the same speed control normally associated with a conventional spool valve along with the low leakage rate ability of a lockout. The positive opening characteristics of the lockout valve are maintained by three separate mechanisms which can be used solely or in combination. The first mechanism is a momentum exchange on the lockout poppet which is caused by the high speed jet of oil passing through the lockout valve changing its direction of travel with a resultant added force attempting to close the lockout thereby requiring a larger control pressure force to further open the lockout. The second mechanism is also a momentum exchange by turning the oil stream against the actuating plunger. The third mechanism is positioning a pilot pressure passage on the face of the poppet away from the high velocity stream which is connected to a servo chamber behind the poppet which senses an increasing pressure as the flow across the poppet begins, thereby creating an additional closing force on the poppet which the control pressure must overcome. The net effect of the last-mentioned three mechanisms is to require the controlling pressure which opens the lockout poppet to increase as the poppet opens so that the poppet does not jump to its full open position.

It is therefore the principal object of the present invention to provide a lockout valve with positive opening characteristics which meter flow based on the pressure in the opposite work port cavity.

It is another object of the present invention to provide a new and improved lockout valve which eliminates the problems of chatter and cavitation when moving heavy loads.

Other objects and advantages of the present invention will become more apparent to those skilled in the art from the detailed description which follows with reference to the accompanying drawings wherein:

FIG. 1 is a longitudinal cross-sectional view of the lockout valve in abstract form with portions of the circuit shown schematically; and FIG. 2 is an opening force versus flow curve to the metering lockout check of the present invention compared with a conventional lockout valve.

DESCRIPTION OF THE PREFERRED EMBODIMENT OF THE DRAWING

Figure 1:
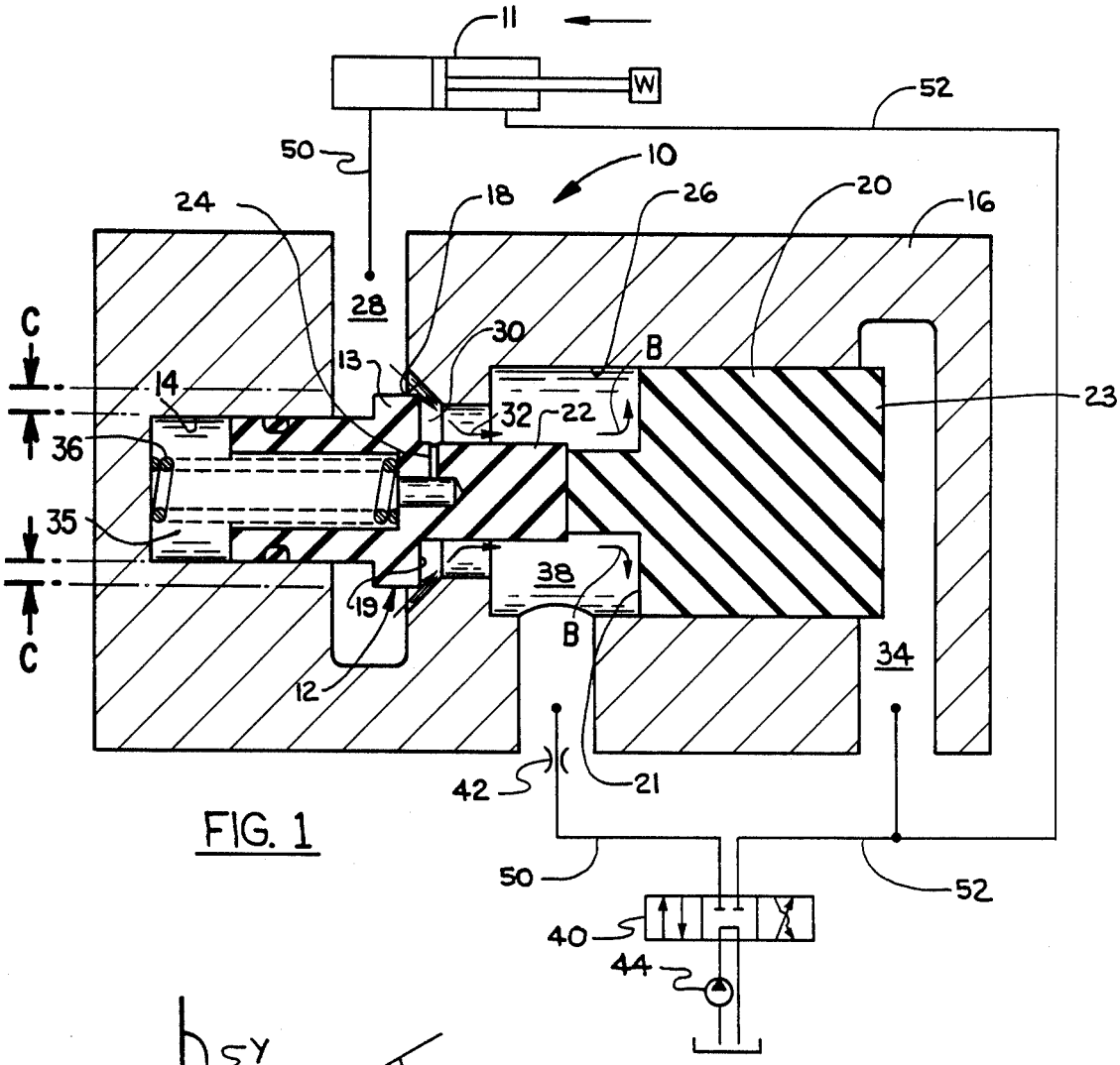

With reference to FIG. 1, the lockout valve of the present invention, generally described by reference numeral 10, is located in valve body 16. A conventional four-way three-position directional control valve 40 operates a double acting cylinder or motor 11 through lockout valve 10 positioned in conduit 50, which will be referred to as the left work port conduit of control valve 40. The right work port conduit 52 of valve 40 is connected to the rod end of cylinder 11. Also connected to right work port conduit 52 is a servo cavity 34 in the lockout valve 10. The lockout valve could also be used with a single acting cylinder and a three-way valve, as well as with a rotary motor.

Lockout valve 10 comprises a poppet member 12 slidably positioned in sealing engagement in bore 14 which in turn contacts a concave conical seat 18. Poppet 12 includes an enlarged head 13 whose right annular edge provides the sealing contact with seat 18. Due to the enlarged diameter of head 13 over bore 14, any pressure in cavity 28 acting on annular area C will assist compression spring 36 in holding poppet 12 closed. Poppet 12 includes a stem portion 22 which extends past seat 18 into contact with plunger member 20. Located at the base of stem 22 is a pressure sensing passage 24 which connects with the spring chamber or cavity 35 behind poppet member 12. Sensing passage 24 could also be positioned. somewhere on the face 19 of the poppet. Positioned downstream of poppet 12 is a cavity 38 which is defined by a bore 26 which slidably receives a plunger member 20. Plunger 20 is shown with a short leftward extending stem contacting with stem 22, however, the stem on the plunger member 20 could be eliminated and stem 22 merely extended or the reverse could be done. The right end 23 of plunger member 20 is exposed to actuating pressure in servo cavity 34 from the right motor port conduit 52 which is in turn connected to the rod end of cylinder 11. As the poppet 12 opens, a high velocity jet of oil 32 flows through the annular opening between the poppet 12 and seat 18 and impacts on stem 22. The stem 22 causes the stream 32 to turn, and flow horizontally until it impacts the left end 21 of plunger 20 wherein the stream again turns, as indicated by arrow B, prior to exiting cavity 38. Located adjacent the high velocity jet 32 at the juncture of stem 22 with poppet face 19 is a static pool of oil 30 whose pressure is sensed in chamber 35 via sensing passage 24. The momentum exchange of high speed jet 32 on stem 22 causes an increase in pressure in static pool 30 which in turn increases the closing force on poppet 12 due to the pressure increase in cavity 35.

While only a single lockout valve 10 is shown in the FIG. 1 system, typically there will be two lockouts, one in each motor port. Lockout valves in general are positioned between the motor being operated and the directional control valve controlling the motor. In most applications, the lockout valve is actually located in the body of the directional control valve rather than remotely positioned, as symbolically shown in FIG. 1. If a second lockout valve was utilized in the FIG. 1 circuit, it would be positioned in the conduit 52 and would block the pressure returning from the rod end of cylinder 11 to the directional control valve 40, and the control pressure in cavity 34 would be connected with the pressure in conduit 50.

OPERATION

When directional control valve 40 is neutrally positioned, poppet 12 will be in its closed position. With a heavy inertial load W supported by motor 11, there will be a substantial pressure in cavity 28 acting on the annular area C of the poppet holding the lockout closed. In this closed position of poppet 12, there is no pressure in spring chamber 35.

When directional control valve 40 is shifted to the right, to the straight through position, pump pressure from pump 44 enters conduit 50 from the left work port and builds pressure in cavity 38 while right motor port conduit 52 is opened to drain.

As soon as the pump pressure in cavity 38 creates sufficient force to overcome the closing force on the poppet, the poppet 12 opens and allows pump flow to the lower end of cylinder 11. The net opening force acting on poppet 12 from pressure in cavity 38 is also an annular area since the sensing passage 24 opens the pump pressure to the backside of the poppet and spring chamber 35.

Whenever directional control valve 40 is shifted from the straight-through position to a neutral position, poppet 12 will close due to the force of sring 36 and thereby seal the load pressure from cylinder 11 in cavity 28.

Figure 2:
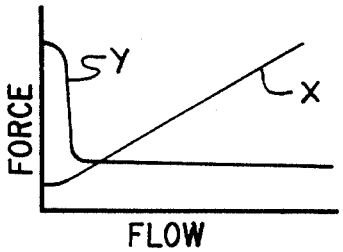

When it is desirous to lower the gravity load on cylinder 11, directional control valve 40 is shifted leftwardly to the criss-cross position which opens left motor port conduit 50 to drain, while opening right motor port conduit 52 to the rod end of cylinder 11 and also servo cavity 34 in the lockout valve. Before lockout poppet 12 can be opened, the load force holding the poppet closed acting on area C, must be overcome along with the nominal force of spring 36. This is accomplished by pump pressure in cavity 34 acting on the right end 23 of plunger 20. As the force from plunger 20 begins to open poppet 12, a high velocity jet of oil 32 flows between the poppet seat 18 and the poppet head 13 in an annular area. The high velocity jet 32 impacts the stem 22 on the poppet and is turned horizontally, traveling over to the left face 21 of plunger 20 where it is again turned outward, as indicated by arrows B. The momentum exchange on the poppet 12 and plunger 20 caused by turning the high velocity jet, imparts a force attempting to close the poppet, which means the initial opening force in servo cavity 34 must be increased to maintain the poppet open. A force-flow curve X, shown in FIG. 2, illustrates how the force necessary in servo cavity 34 increases as the poppet 12 opens and allows a higher rate of flow. Curve Y on the same graph illustrates how conventional lockouts move from a closed position to a fully open position since the force required to hold the lockout open drops once flow begins. Lockout poppet 12 meters the discharge flow from cylinder 11, and if it is desirous to increase the rate of lowering the load W, additional pressure must be applied in servo chamber 34 by further opening directional control valve 40.

Another factor which increases the closing force on poppet 12, as flow beings, includes the positioning of sensing passage 24 adjacent a static pool of oil 30 at the juncture of the face 19 of the poppet and stem 22, whereby the pressure on that static pool is transmitted to spring chamber 35 which in turn applies a closing force on the poppet 12. The turning of the high speed jet 32 on the poppet stem 22 causes the pressure to increase in the static pool 30 which in turn increases the closing force on poppet 12. This factor along with the momentum exchange upon the stem 22 and plunger 20 both contribute to the positive opening characteristics of the poppet 12, either alone or in combination. The positive opening characteristics of poppet 12 could further be increased by increasing the spring rate of spring 36 so that the spring force increased at a much higher rate as the poppet opened.

Since there always must be sufficient pressure in servo cavity 34 to hold poppet 12 open there is no chance of cavitation in the rod end of cylinder 11 since poppet 12 requires positive pressure in cavity 34 to remain open. With the lockout 10 of the present invention, a gravity load on cylinder 11 can be rapidly lowered without inlet cavitation.

The presence of orifice 42 in the drain line downstream of directional control valve 40 builds a slight back pressure in cavity 38 which prevents cavitation adjacent the high speed jet 38. In some hydraulic circuits there is sufficient obstruction in the drain line to create the necessary back pressure in cavity 38 to prevent the formation of bubbles in the oil, generally referred to as cavitation.

Having described the invention with sufficient clarity to enable those familiar with the art to contruct and use it, I claim:

1. A metering lockout check valve in a hydraulic circuit including a pump and reservoir supplying a motor through a directional control valve, the lockout valve being placed in the circuit between the motor and directional control valve normally blocking flow from the motor, the lockout valve comprising:

a body having a central passage therein, first and second cavities intersecting said central passage, the first cavity connected to the motor with the second cavity connected to a work port of the directional control valve;

a seat means positioned in the central passage between the first and second cavities;

a first bore positioned adjacent to said central passage;

a movable poppet means slidably positioned in said first bore defining a servo chamber, spring means urging the poppet means closed against the seat, the poppet means including a head portion with a face which seals against said seat, the head portion having a larger diameter than said first bore whereby a closing area is provided on the poppet means subject to pressure in said first cavity urging the poppet closed, the poppet means including a sensing passage connecting the face of the poppet means with the first bore;

a servo plunger in the body sensing the pump discharge pressure; and stem means positioned between said poppet means and said servo plunger to open the poppet means.

2. A metering lockout valve as set forth in claim 1, wherein the seat means has a concave conical face.

3. A metering lockout valve as set forth in claim 1, wherein the seat means has a concave conical face and the stem means is concentrically positioned within the central passage whereby the high velocity jet of oil passing through the lockout valve impacts with the stem means and turns the jet to a longitudinal direction.

4. A metering lockout valve as set forth in claim 1, wherein the seat means has a concave conical face and the stem means is concentrically positioned on the poppet face whereby the high velocity jet of oil passing through the lockout valve impacts with the stem means and turns the jet to a longitudinal direction.

5. A metering lockout valve as set forth in claim 1, wherein the seat means has a concave conical face and the stem means is concentrically positioned within the central passage whereby the high velocity jet of oil passing through the lockout valve impacts with the stem means turning the jet to a longitudinal direction and the servo piston has an end surface which turns the high velocity jet from its said longitudinal direction.

6. A metering lockout valve as set forth in claim 1, wherein the seat means has a concave conical face and the stem means includes a portion on the face of the poppet and a portion on the end of the servo plunger both of which are concentrically positioned with respect to each other and the poppet means.

7. A metering lockout valve as set forth in claim 1, wherein the seat means has a concave conical face and the stem means is concentrically positioned and attached to the servo plunger.

8. A metering lockout valve as set forth in claim 1, wherein the seat means has a concave concial face and the stem means is concentrically positioned on the face of the poppet means with said sensing passage located therein whereby the high velocity jet of oil passing through the lockout valve impacts with the stem means and turns the jet to a longitudinal direction.

* * * * *